United States Patent [19]

White

[11] Patent Number: 4,917,600

[45] Date of Patent: Apr. 17, 1990

[54] RECIPROCAL FURNACE FOR HEATING METAL PARTS

[75] Inventor: Raymond E. White, East Longmeadow, Mass.

[73] Assignee: American Saw & Mfg. Company, East Longmeadow, Mass.

[21] Appl. No.: 407,230

[22] Filed: Sep. 14, 1989

[51] Int. Cl.[4] ..... F27B 9/14; F24J 3/00

[52] U.S. Cl. ..... 432/121; 432/6; 432/230

[58] Field of Search ..... 432/121.6, 123, 134, 432/153, 154, 162, 230, 231

[56] References Cited

U.S. PATENT DOCUMENTS 3,988,106 10/1976 Mendelsohn et al. ..... 432/230

*Primary Examiner*—Henry C. Yuen

*Attorney, Agent, or Firm*—Chapin, Neal & Dempsey

[57] ABSTRACT

Reciprocal furnace for heating metallic parts to a predetermined temperature has a horizontally reciprocal hearth. The hearth includes a multi-layer firebrick base on which is carried a ceramic fixture adapted to receive the metal parts to be heated in the furnace. The ceramic fixture has a plurality of parallel slots which are longitudinally spaced apart in a direction corresponding to the reciprocal movement of the hearth. The hearth is supported at its underside by a reciprocal drive mechanism and is moved incrementally by a drive motor to advance each slot of the fixture in sequence to a predetermined position at which a part is inserted therein by the reciprocal feed mechanism. After all the slots have been sequentially loaded, the hearth is retracted by the reciprocal drive mechanism to its initial position at which the part, first inserted, is removed and another part is inserted in the same slot. The loading and unloading cycle is repeated continuously. The total time for loading all the slots and retracting the fixture to its initial position, at which the first part is removed, is equal to the cycle time necessary to heat the parts to the predetermined temperature.

5 Claims, 4 Drawing Sheets

RECIPROCAL FURNACE FOR HEATING METAL PARTS

BACKGROUND OF THE INVENTION

This invention relates to a reciprocal furnace hearth for heating metallic parts for further processing, such as hot-forming the parts into any desired form, such as hole saw blades of cylindrical configuration.

It has generally been the practice in the past to fabricate tools, such as hole saws, by individually heating flat saw blades in an open gas flame. Even at the present time, this open hearth technique still persists for making hole saws larger than three inches in diameter. The open hearth process, including timing of the heating cycle, is manually controlled by the individual operator whereby the quality of the hole saws produced is dependent on the skill and diligence of the operator. Another drawback of the open hearth furnace, resulting from the oxygen supported combustion employed in the open hearth, is extensive scaling of the hole saw blades which requires grit blasting to remove the scale after the hot-forming operation.

It had also been proposed to heat metallic parts in a linear furnace in which the parts are carried through the furnace on a continuous link-chain conveyor. This system was not considered feasible, however, because of the inability of the chain feed to withstand the high operating furnace temperatures, in excess of 2,000 degrees Fahrenheit. One proposed solution was disclosed in U.S. Pat. No. 3,656,720 for a HEAT TREATING FURNACE WITH WALKING BEAM DRIVE.

Very recently, the rotary furnace has found acceptance for high quality, small diameter, hole saws in which saw blade blanks are electrically heated in an inert atmosphere. Saw blades are intermittently inserted at one position into a rotatable ceramic hearth within the furnace and removed after predetermined angular rotation. The loading and unloading steps are continuous and upon removal, each blade is hot-formed on a mandrel to the cylindrical configuration required for hole saws. While the rotatable furnace has been successfully utilized for fabricating hole saws, it was found practicable for small hole saws of less than three inches in diameter.

While the rotary furnace is suitable in making smaller size hole saws, it is not practicable for larger size hole saws because the overall diameter of the furnace and hearth would have to be increased by a factor of two times the increase in hole saw diameter. Thus, for every one inch increase in hole saw diameter, it would mean a $2\pi$ or 6.28 inch increase in the size of the rotary furnace whereby a six inch hole saw would require a ceramic hearth having a diameter almost nineteen inches larger than the diameter of the hearth used for a three inch hole saw. A ceramic hearth of such large size would have a tendency to crack in such high temperature applications and would require frequent replacement.

There are a number of prior United States patents which disclose a reciprocable mechanism for batch heating of various work pieces in furnaces, including U.S. Pat. Nos. 1,280,037; 1,741,624; 2,842,352; 3,563,434; 3,744,650 and 4,695,706. U.S. Pat. No. 2,600,401 discloses a reciprocating hearth mechanism which depends upon inertia to slip and slide work pieces along the surface of a reciprocal hearth. U.S. Pat. No. 3,656,720 discloses a heat-treating furnace with a walking beam assembly for moving work pieces through a high temperature zone. None of these patents, however, discloses a reciprocal hearth which is sequentially loaded and unloaded within the high temperature zone of the furnace per se.

It is the principal object of this invention to provide a reciprocal furnace hearth for heating metallic parts to a predetermined temperature for further processing and which overcomes the limitations of all the previously available types of furnaces, including the rotary hearth type adaptable for a similar purpose.

The above and other objects and advantages of this invention will be more readily apparent from the following description read in conjunction with the following drawings in which.

Figure 4:
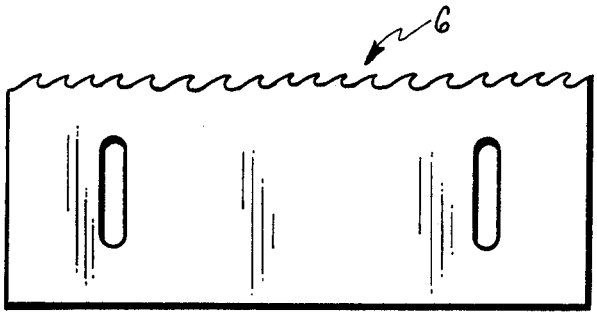
Figure 4:
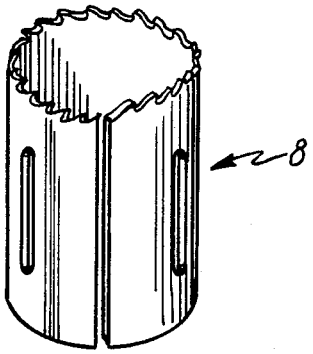

FIG. 4 consists of an elevational view and perspective view, respectively, of a saw blade blank as may be heated in the furnace and its cylindrical configuration after subsequent hot-processing of the blank.

DETAILED DESCRIPTION OF THE INVENTION

Figure 1:
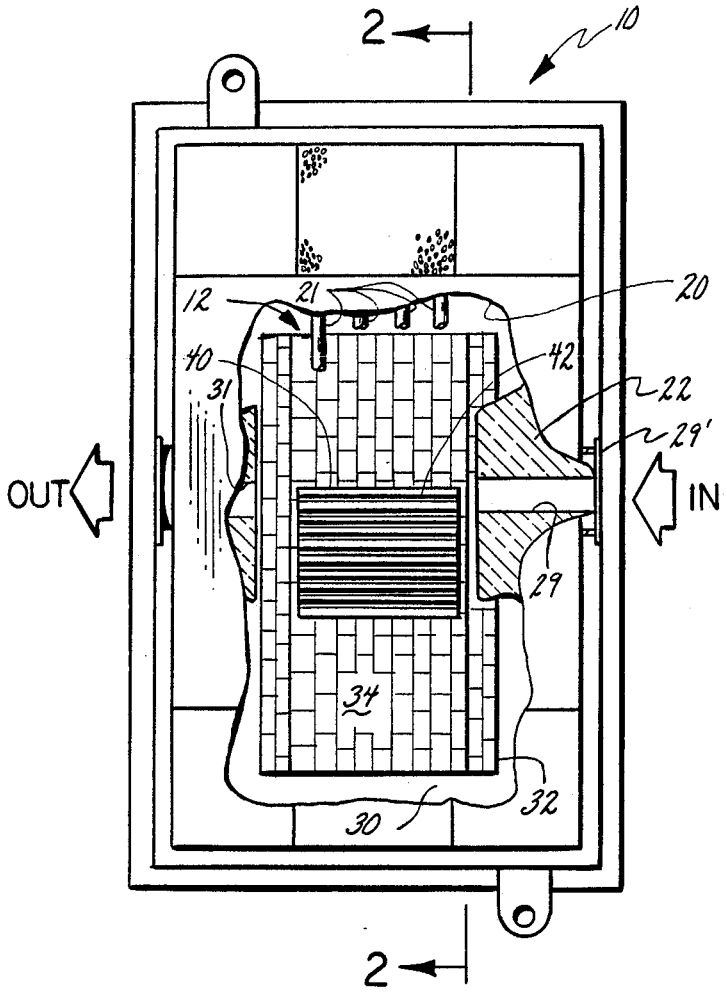
FIG. 1 is a plan view, partly in section, showing a reciprocal furnace of the type embodying this invention.

In FIG. 1 is shown a furnace 10 with a reciprocal hearth 12 disposed entirely within the furnace. Metal parts, such as flat saw blades called "blanks" 6 (FIG. 4) are introduced into the furnace 10 which includes reciprocal hearth 12 on which the flat blades 6 are heated to a predetermined temperature, such as their heat-treating or forming temperature. After removal from the furnace, the blanks may be hot-formed into any desired shape, such as the cylindrical configuration 8 of hole saws.

Figure 2:
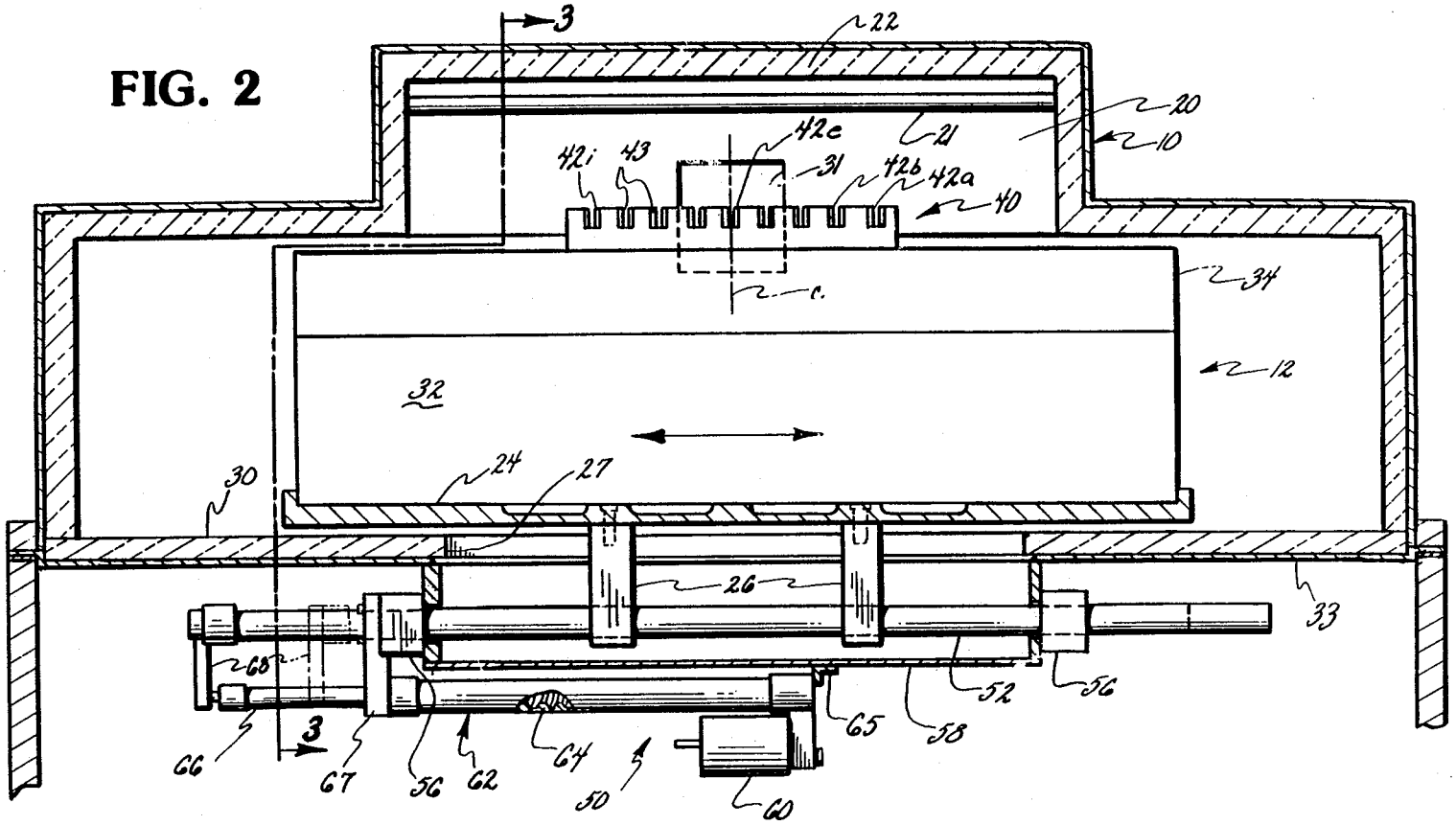
FIG. 2 is a section taken along line 2—2 of FIG. 1.
Figure 3:
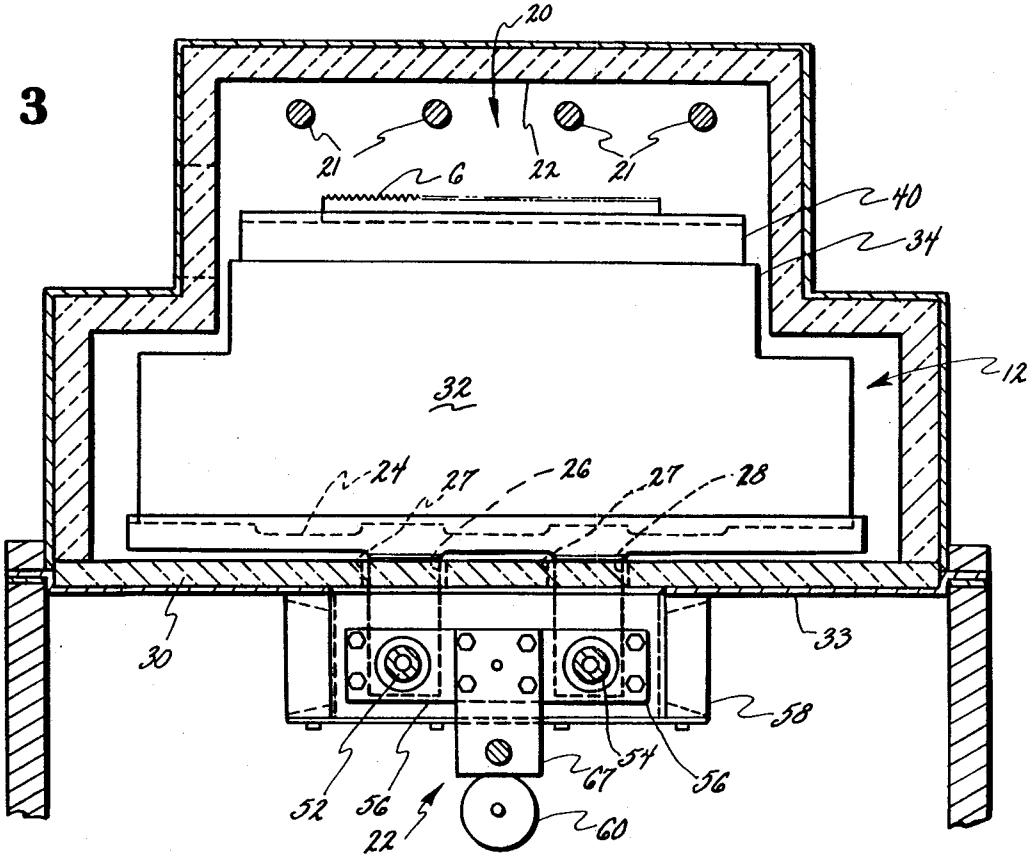
FIG. 3 is a section taken along line 3—3 of FIG. 2.

As illustrated in FIGS. 1–3, the furnace 10 comprises an essentially "closed" chamber 20 defined by an outer shell 19 lined with firebrick walls 22 of stepped configuration. The furnace 10 is mounted on a rectangular base having upright walls 23. Disposed within the top portion of the furnace chamber, are electrical resistance heaters 21 of silicon carbide called "GLOBARS". The reciprocal hearth 12 is disposed directly below the "GLOBARS" and is carried on a support or base plate 24 (FIG. 2) by means of two pairs of support brackets 26 and 28 (FIG. 3). The brackets extends through a pair of elongated, laterally spaced slots 27 provided through the bottom wall or base 30 of the furnace, formed of a suitable heat resistant refractory material and disposed on a steel support plate 33. On opposite sides of the reciprocal hearth, openings 29 and 31 are provided for the insertion of the parts to be processed by the furnace and removal when heated to within any predetermined temperature range for further processing. Opening 29 is provided with a slidable door 29' which is adapted to selectively "open" and "close" the access opening into the furnace in which is maintained a pressurized inert atmosphere, such as nitrogen gas which is supplied by conduit means not shown.

Reciprocal hearth 12 comprises three vertically stacked tiers of firebrick 32 with its upper tier 34 being narrower in width than the two lower tiers. This arrangement interfits closely with the stepped configuration of the furnace walls to provide a labyrinth which serves to limit the migration of heat from the upper region of the furnace chamber to the lower parts thereof where it may adversely affect the operation of durability of the reciprocal drive mechanism 50 (FIG. 2). A ceramic work holder 40 is centrally located on the upper surface of the top tier firebrick and, together with the three brick tiers, forms the reciprocal hearth on which the work pieces, such as flat saw blade blanks 6 are heated to their forming temperature for hot-forming into cylindrical hole saw configuration, as depicted as 8 in FIG. 4.

The work or blade holder 40 comprises a heat-resistant, unitary ceramic block centrally disposed on and secured to the upper surface of the firebrick base. The upper edge portion of the work holder is provided with a plurality of parallel slots 42 equally spaced apart in a longitudinal direction which corresponds to the direction of movement of the hearth. Preferably, and in the illustrated embodiment, nine such slots **42*a*–42*i* are provided and spaced apart approximately 1.5 inch, whereby the holder has a longitudinal dimension of approximately fifteen inches and of sufficient width to hold flat blade blanks which will be formed into a six inch hole saw, i.e., approximately nineteen inches in length. At their opposite ends, each slot 42 is flared outwardly, as at 43, to asist as a guide for the insertion of saw blade blanks into the holder. The depth of each slot is substantially less than the width o the saw blade blanks to be heated therein so that when the blade is inserted with its straight edge oriented downwardly, the saw tooth edge of the blade will extend sufficiently above the upper surface of the holder 40** to be readily picked up for removal. The width of each slot is such as to enable easy insertion and removal of the saw blade blanks to and from the slots.

The reciprocal hearth, as illustrated generally at 12 in FIGS. 2 and 3, is supported and carried by two pairs of movable support brackets 26 and 28 and driven by reciprocal drive means 50 (FIG. 3). The four brackets are secured at their upper ends to metallic base plate 24 and extend downwardly through the slots 27 in the base plate 30. Brackets 26 are fastened onto longitudinally movable tubular bar 52 and brackets 28 are fastened onto an identical bar 54 parallel to bar 52. The bars 52 and 54 are supported at opposite ends by spaced ball bearings 56 with sliding seals disposed at the opposite ends of housing 58 which also serves as a closure for the lower portion of the furnace chamber 20. Thus, an inert atmosphere, such as nitrogen, may be maintained within the furnace chamber which is thereby essentially sealed from the outside atmosphere. The tubular rods 52 and 54 are moved axially by drive-motor 60 and linear actuator 62 which rotates a drive-screw 64, as disclosed in U.S. Pat. No. 4,137,784. The drive mechanism is affixed to the underside of the housing 58 by fixed brackets 65 and 67. As lead screw 64 is rotated in either a clockwise or counterclockwise direction, a thrust tube 66 having a screw-fitted meshed with the drive-screw 64 is extended or retracted from the linear actuator 62. The reciprocal motion of the thrust tube is directly coupled to rods 52 and 54 by means of a connecting plate or thrust bracket 68. As the rods, which may be of the Thompson shaft type, are tubular in cross-section, section, if required, a suitable cooling fluid, such as water, may be supplied by flexible hoses (not shown) connected to the ends of the rods. Since there are nine slots **42*a*–42*i* in the saw blade holder 40, a total stroke length of about twelve inches, or six inches on each side of the center line c (FIG. 2**) of the holder will be required for insertion and removal of nine individual saw blade blanks.

With reference to FIG. 2, when the hearth 12 is positioned to its leftmost position, slot 42a of the work holder will be disposed in alignment with the input opening 29 and the output opening 31 of the furnace. In this initial position of the hearth, a flat blade 6 of any length suitable for forming hole saws from 9/16 inch to six inches in diameter will be inserted by the feed mechanism 14 into slot **42*a*. A programmed controller will then actuate drive motor 60 to advance the hearth so that the next slot 42*b* is moved into alignment with the input opening 29 and output opening 31 where another flat blade may be inserted into the slot. The elapsed time between successive blade insertion is about fifteen seconds with incremental, rectilinear movement continuing for approximately two minutes ($8 \times 15$ sec.) at which time a blade will have been inserted in each of the nine slots 42. The drive-motor 60 will then be reversed and in one rectilinear stroke of twelve inches, the hearth is returned to its starting position. The total elapsed time for each of the incremental movements and the single reverse stroke of the hearth is approximately 123 seconds, roughly equal to the requisite time to heat each blade to at least its heat-treating or forming temperature whereupon it will be removed for further processing. As one blank is withdrawn, another blank 6** will be inserted into the same slot and the sequence of withdrawing and inserting blanks is repeated continuously; the only interruption occurring when the hearth is reversed for return to its starting position.

The parts to be heated in the furnace may be inserted and removed from the furnace by any suitable means and such means are disclosed in my co-pending application for *MACHINE FOR HOT-FORMING HOLE SAW BLADES,* Ser. No. 407240 , filed on Sept. 14, 1989.

Among the advantages of this furnace, are its ability to heat-treat metallic parts without size limitation. Despite its versatility, the furnace is relatively compact in size, and operates to heat parts of uniformly higher quality without the scaling problem which characterized products processed in an open hearth furnace.

Having thus described my invention, what is claimed is:

1. Furnace for heating to a predetermined temperature metallic parts including hole saws and the like comprising a furnace having a high temperature heating chamber, a reciprocal movable hearth disposed entirely within said chamber, a ceramic holder for said parts carried by the reciprocal hearth and including a plurality of parallel slots, spaced longitudinally with respect to the direction of reciprocal movement of said hearth, a first opening into said chamber on one side thereof for receiving said metallic parts to be fitted into each of said spaced slots, a second opening disposed on the side of said chamber opposite the first opening for removal of each of said parts from said slots, said hearth having a predetermined starting position in which the slot disposed adjacent one end of the holder is aligned with said first and second openings, means for reciprocally driving said hearth within said chamber in one direction from said starting position in incremental strokes equal to the spacing between adjacent said slots and in the opposite direction to return said hearth to its starting position, the numbers of said slots, the spacing therebetween and the speed of the incremental and return movement of said hearth being selected to provide a heating cycle for each of said parts approximately equal to the time required to heat each of said parts to said predetermined temperature.

2. Furnace for heating to a predetermined temperature metallic parts including hole saws and the like, as set forth in claim 1, in which said ceramic holder comprises a plurality of parallel slots, each having a length sufficient to accommodate flat saw blades used to form hole saws larger than 3 inches in diameter.

3. Furnace for heating to a predetermined temperature metallic parts including hole saws and the like, as set forth in claim 1, in which said ceramic holder comprises nine parallel slots having a length sufficient to accommodate flat saw blades used to form hole saws from 9/16 inch to 6 inches in diameter and a spacing between adjacent slots of approximately 1.5 inch.

4. Furnace for heating to a predetermined temperature metallic parts including hole saws and the like, as set forth in claim 1, in which said hearth and ceramic holder are supported by laterally-spaced, longitudinally movable bars disposed at the underside of said hearth.

5. Furnace for heating to a predetermined temperature metallic parts including hole saws and the like, as set forth in claim 4, in which said longitudinally movable support bars are driven by a linear drive mechanism.

* * * * *